US007111564B2

(12) United States Patent
Chang

(10) Patent No.: US 7,111,564 B2
(45) Date of Patent: Sep. 26, 2006

(54) COMBINATION FRAME STRUCTURE FOR TABLE COMBINATION TABLE USING COMBINATION FRAME STRUCTURE

(76) Inventor: Chien-Kuo Chang, P.O. Box 36-80, Taichung City (TW)

( * ) Notice: Subject to any disclaimer, the term of this patent is extended or adjusted under 35 U.S.C. 154(b) by 218 days.

(21) Appl. No.: 10/932,366

(22) Filed: Sep. 1, 2004

(65) Prior Publication Data

US 2006/0042523 A1 Mar. 2, 2006

(51) Int. Cl.
*A47B 3/06* (2006.01)

(52) U.S. Cl. ..... 108/155; 108/157.1; 108/50.02

(58) Field of Classification Search ..... 108/154, 108/155, 156, 157.1, 157.17, 50.01, 50.02; 312/223.3; 248/188, 188.1
See application file for complete search history.

(56) References Cited

U.S. PATENT DOCUMENTS 936,007 A * 10/1909 Mauborgne ..... 108/33
4,748,913 A * 6/1988 Favaretto et al. ..... 108/50.02
4,824,058 A * 4/1989 Glendinning ..... 248/164
4,836,492 A * 6/1989 Kennedy et al. ..... 248/676
4,944,235 A * 7/1990 Jahnke et al. ..... 108/159.11
4,966,341 A * 10/1990 Borsani ..... 248/165
5,165,638 A * 11/1992 Fallon et al. ..... 248/188.7
5,205,223 A * 4/1993 Ball et al. ..... 108/124
5,638,759 A * 6/1997 Klugkist ..... 108/50.02
5,967,631 A * 10/1999 Ko ..... 312/194
6,024,024 A * 2/2000 Favaretto ..... 108/64
6,196,140 B1 * 3/2001 Newhouse et al. ..... 108/50.01
D506,887 S * 7/2005 McDiarmid ..... D6/480
6,968,790 B1 * 11/2005 Kocsis ..... 108/157.1
6,997,114 B1 * 2/2006 Chang ..... 108/64
2002/0059889 A1 * 5/2002 Fangmann ..... 108/157.17
2004/0011259 A1 * 1/2004 Meadows ..... 108/115

FOREIGN PATENT DOCUMENTS

DE 4028457 * 12/1992

* cited by examiner

*Primary Examiner*—Janet M. Wilkens
(74) *Attorney, Agent, or Firm*—Charles E. Baxley

(57) ABSTRACT

A combination frame structure for combination table is disclosed to include a beam, two stands and two table board support members respectively provided at the top and bottom sides of the beam, and screws inserted through respective mounting through holes at the flat top of each stand and longitudinal slots in the beam and threaded into respective bottom mounting holes at the bottom side of the flat base of each table board support member to affix the table board support members and the stands to the beam.

13 Claims, 4 Drawing Sheets

COMBINATION FRAME STRUCTURE FOR TABLE COMBINATION TABLE USING COMBINATION FRAME STRUCTURE

BACKGROUND OF THE INVENTION

1. Field of the Invention

The present invention relates to a table and more particularly, to a combination frame structure for table, which enables the user to set up a combination table easily subject to one's needs.

2. Description of the Related Art

Regular desks or computer tables are designed and made in factory subject to predetermined specifications. The specifications of these desks or computer tables may not fit individual's needs perfectly. For cost's sake, manufacturers cannot accept small orders from consumers for different specifications. Therefore, consumers can only select desks or computer tables from the market, or pay extra money for a custom-made design.

SUMMARY OF THE INVENTION

The present invention has been accomplished under the circumstances in view. It is main object of the present invention to provide a combination frame structure, which enables the user to set up a combination table by oneself easily without special training. It is another object of the present invention to provide a combination frame structure, which enables the user to set up a combination table subject to one's needs.

To achieve these and other objects of the present invention, the combination frame structure comprises a beam, the beam comprising at least one longitudinal slot; a plurality of stands for supporting the beam in horizontal, each the stand comprising a flat top for supporting the beam, and two legs connected to the flat top for supporting the flat top above the floor, the flat top having at least one mounting through hole corresponding to the at least one longitudinal slot of the beam; and a plurality of support members respectively fastened to the stands and supported on the beam for supporting a table board, each the support member comprising a flat base, and two support arms respectively extended from the flat base at two sides for supporting a table board above the beam, the flat base having at least one bottom mounting hole corresponding to the at least one longitudinal slot of the beam and the at least one mounting through hole of the stands.

DETAILED DESCRIPTION OF THE PREFERRED EMBODIMENT

Figure 1:
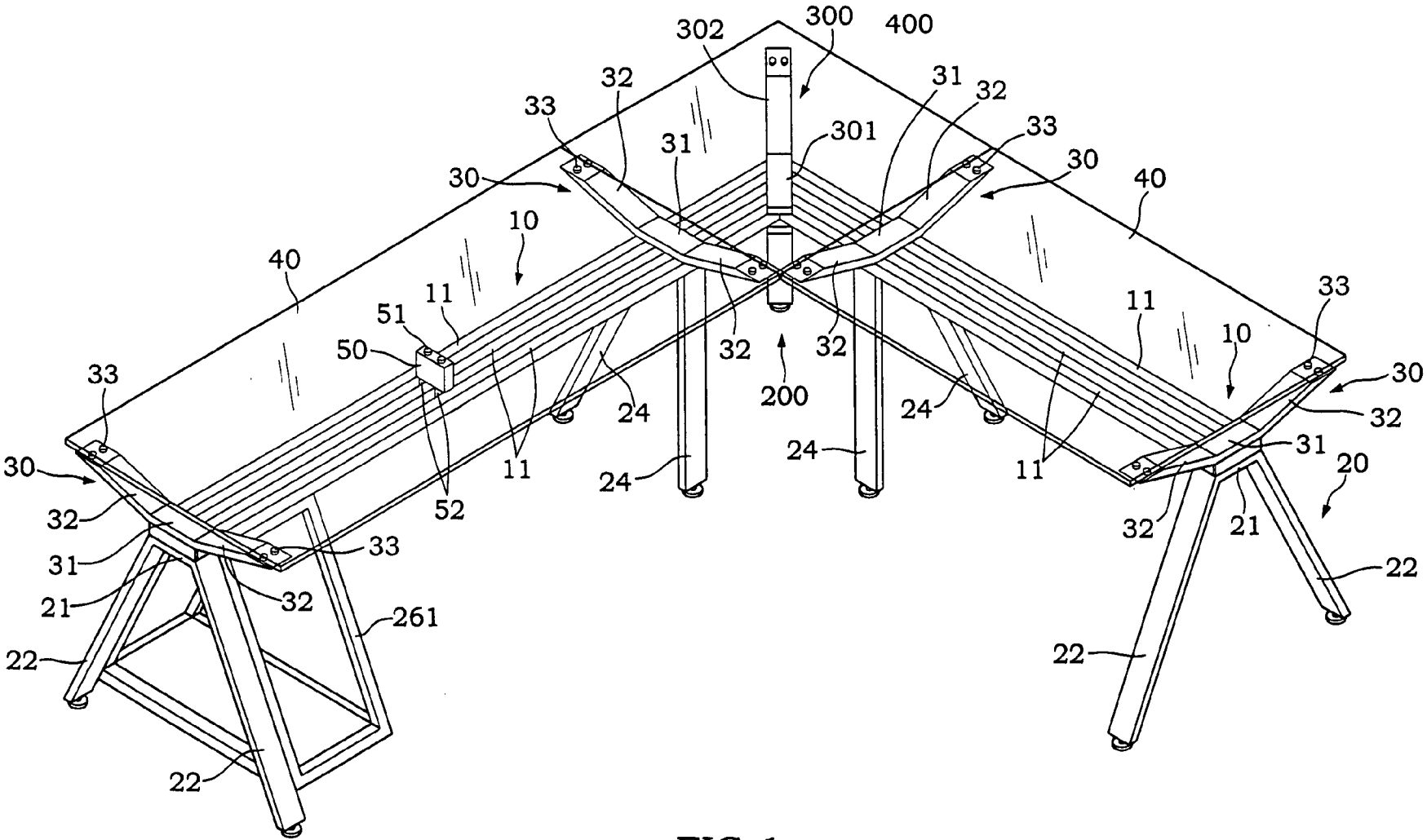
FIG. 1 is a perspective view of a combination table constructed according to the present invention.
Figure 3:
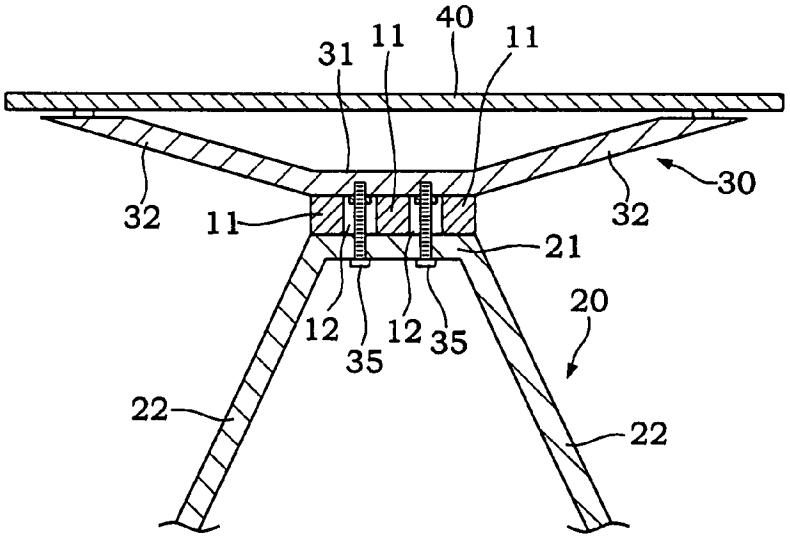
FIG. 3 is a sectional assembly view of FIG. 2.
Figure 2:
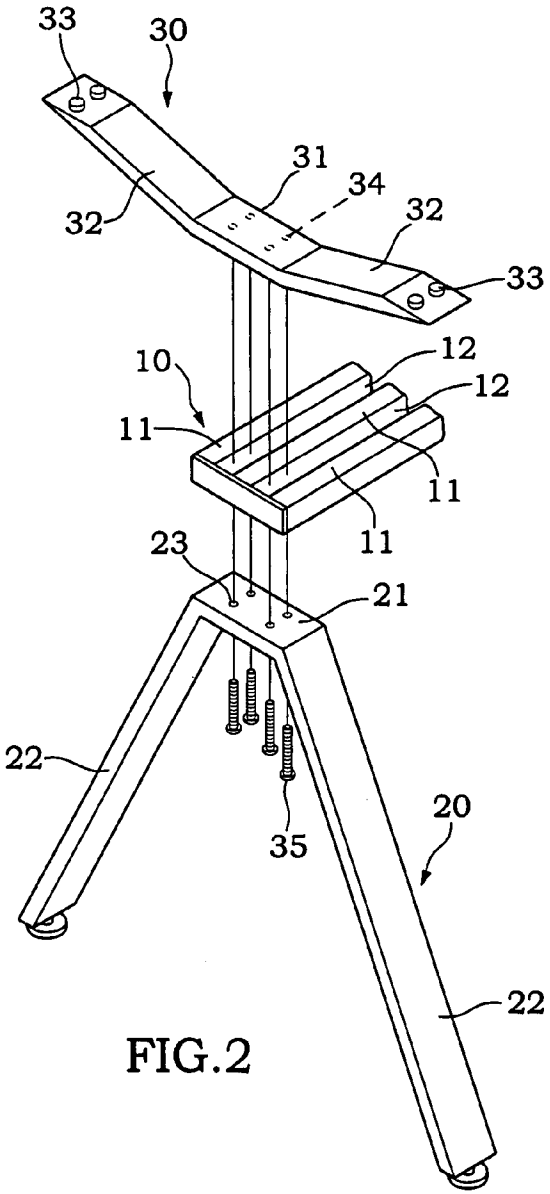
FIG. 2 is an exploded view of a part of the present invention, showing the structure of the stand, the support member and the beam.

Referring to FIGS. 1–3, a combination frame structure for combination table in accordance with the present invention is shown comprised of a beam 10, a plurality of stands 20, and a plurality of support members 30.

The beam 10 is comprised a plurality of, for example, four rod members 11 joined together and arranged in parallel, defining a plurality of longitudinal slots 12 in between each two adjacent rod members 11.

Each stand 20 has a flat top 21 and two legs 22. The two legs 22 are obliquely downwardly extended from the flat top 21 at two sides. The flat top 21 is horizontally connected between the legs 22 at the top side, having a plurality of mounting through holes 23 extended through the top and bottom walls corresponding to the longitudinal slots 12 of the beam 10.

Each support member 30 comprises a flat base 31 and two support arms 32 obliquely upwardly extended from the flat base 31 at two sides. The flat base 31 has a plurality of vertical mounting holes 34 formed in the bottom wall corresponding to the through holes 23 in the flat top 21 of each stand 20. The support arms 32 each have the respective free end fixedly provided with an anti-skip device 33 for supporting one table board 40.

During installation, the beam 10 is supported on two stands 20, and then two support members 30 are respectively transversely attached to the two distal ends of the beam 10 corresponding to the stands 20, and then fastening members (for example, screws) 35 are respectively upwardly inserted through the mounting through holes 23 of the stands 20 and the longitudinal slots 12 of the beam 10 and fastened to the vertical mounting holes 34 of the support members 30 to fixedly secure the support members 30 and the beam 10 to the stands 20. When loosened the fastening members 35, the support members 30 can be moved with the stands 20 relative to the beam 10 along the longitudinal slots 12 to adjust the pitch between the two support members 30. After adjustment, the fastening members 35 are fastened tight again, and then the table board 40 is positioned on the anti-skip devices 33 at the two support members 30.

FIG. 1 shows many different forms of the stand 20. For example, the stand 20 can be made having a flat top 21 and two legs 22 downwardly outwardly extended from the flat top 21 at two sides. The form is suitable for supporting the ends of the beam. Alternatively, the stand 20 can also be made having two legs 24, one set in vertical and the other set in an oblique manner. This form is suitable for supporting a middle part of the beam. Further, a rack 261 may be attached to one stand 20 for holding, for example, a computer.

Figure 5:
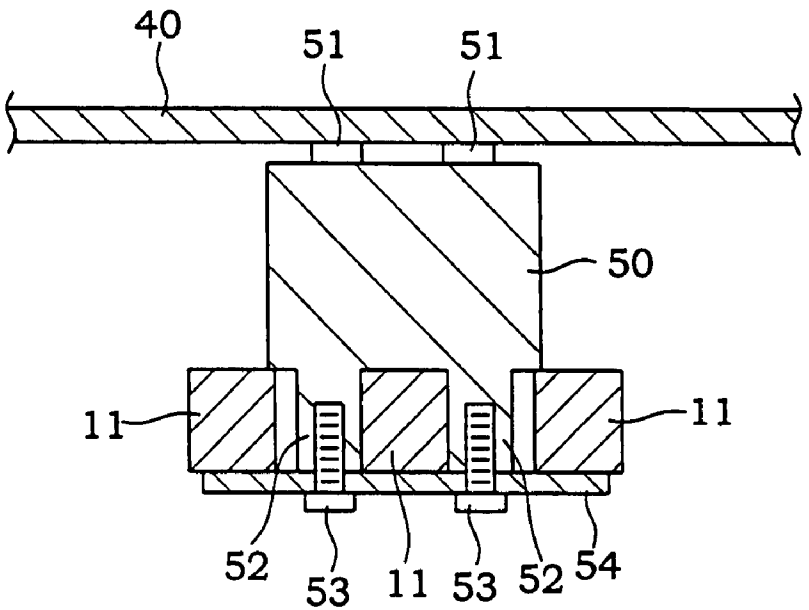
FIG. 5 is a sectional assembly view in an enlarged scale of FIG. 4.
Figure 4:
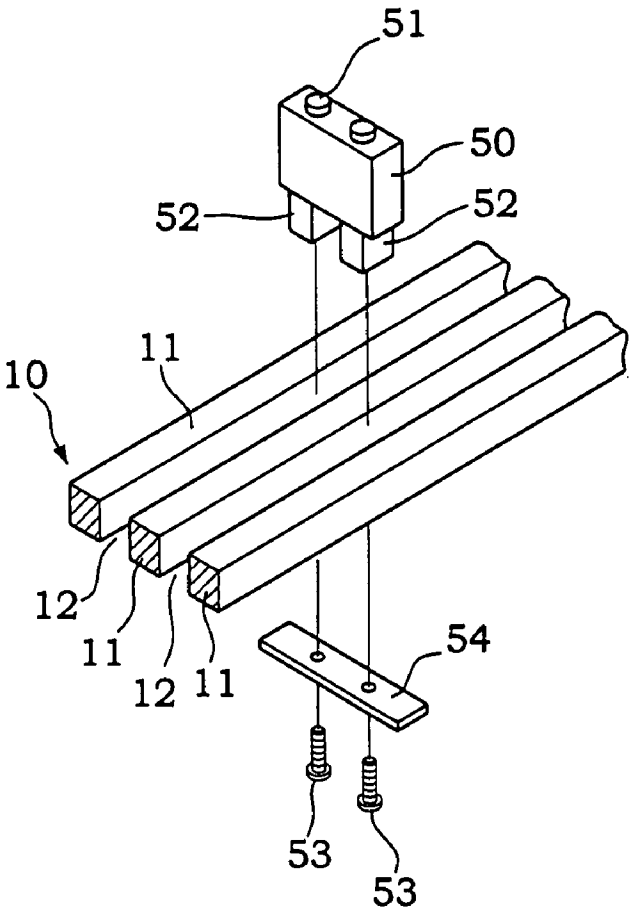
FIG. 4 is an exploded view of a part of the present invention, showing the positioning of one spacer block at one beam.

Referring to FIGS. 4 and 5 and FIG. 1 again, a spacer block 50 may be set between two support members 30 to support the table board 40 on the beam 10. The spacer block 50 has an anti-skid device 51 fixedly provided at the top side for supporting the table board 40, and two bottom rods 52 inserted through the longitudinal slots 12 of the beam 10. Fastening members, for example, screws 53 are fastened to the bottom rods 52 of the spacer block 50 to affix a stop plate 54 to the spacer block 50 below the beam 10. When loosened the screws 53, the spacer block 50 can be moved along the longitudinal slots 12 to the desired location at the beam 10.

Figure 7:
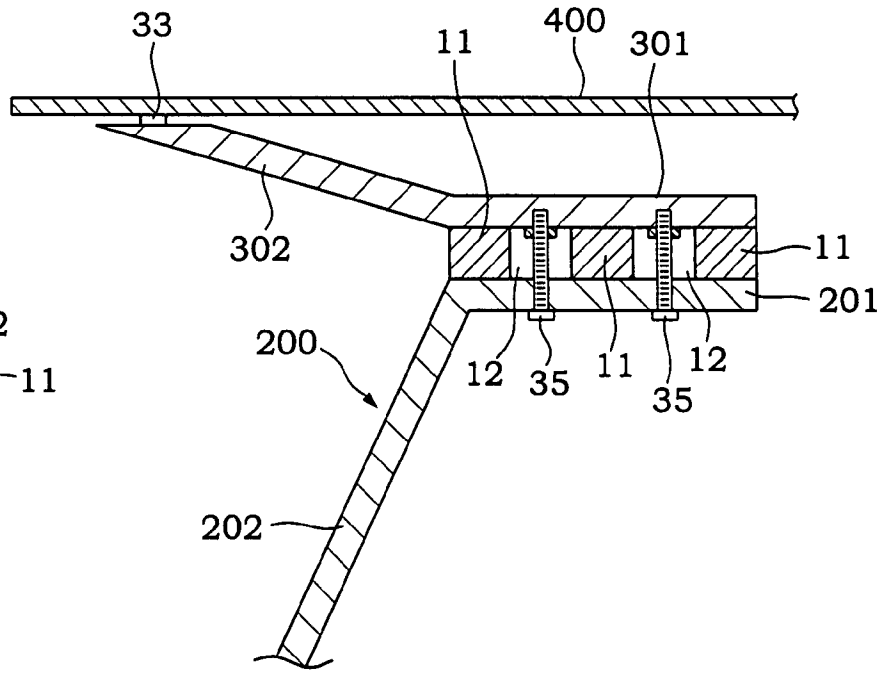
FIG. 7 is a sectional view of the present invention, showing the corner table board supported on the corner support member above the corner stand.
Figure 6:
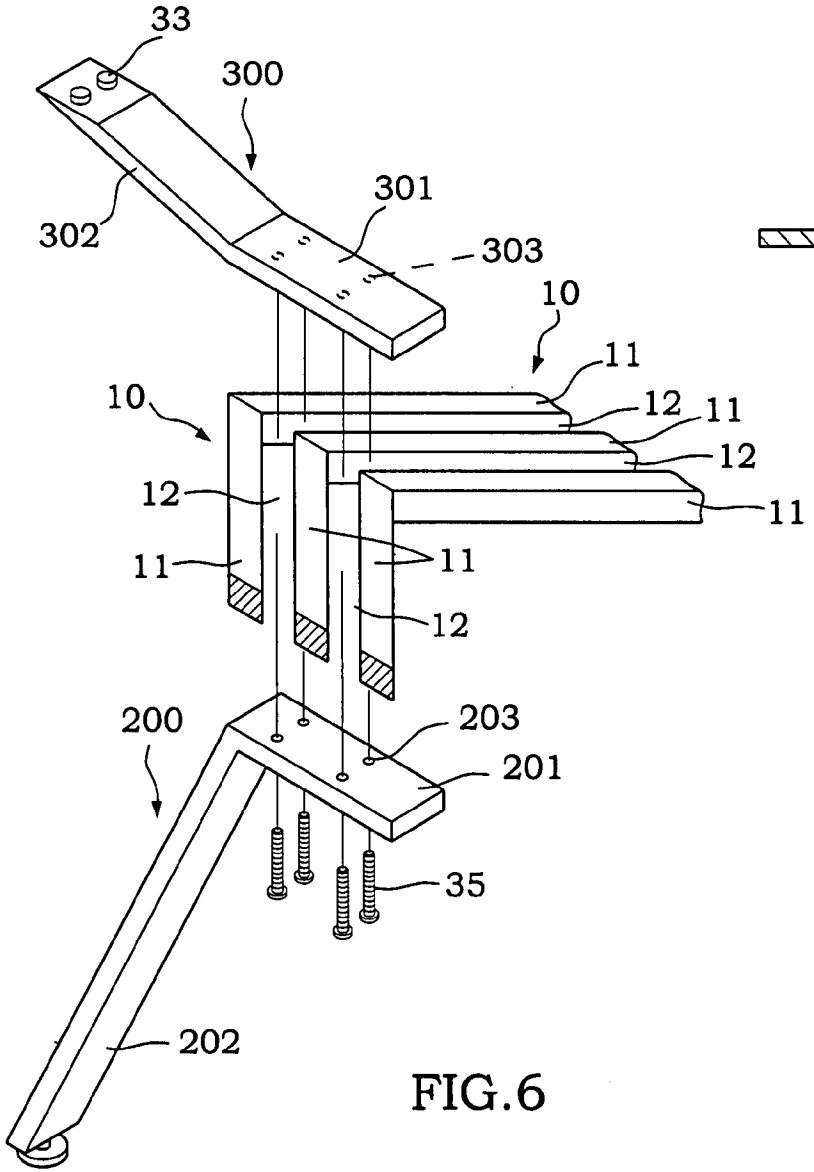
FIG. 6 is an exploded view of a part of the present invention, showing the structure of the corner stand and the corner support member.

Referring to FIGS. 6 and 7 and FIG. 1 again, the combination frame structure for table further comprises a corner stand 200 and a corner support member 300 for supporting a corner table board 400 between two table boards 40 at two beams 10 that are supported on stands 20 and abutted against each other at right angles. The corner stand 200 comprises a flat top 201 and a leg 202 downwardly obliquely extended from the flat top 201 at one side. The flat top 201 has a plurality of mounting through holes 203 for mounting. The corner support member 300 comprises flat base 301 and a support arm 302 obliquely upwardly extended from the flat base 301 at one side. The flat base 301 has a plurality of vertical mounting holes 303 formed in the bottom wall corresponding to the through holes 203 in the flat top 201 of the corner stand 200. The support arm 302 has the free end fixedly provided with an anti-skip device 33 for supporting the corner table board 400. Fastening members, for example, screws 35 are respectively fastened to the mounting through holes 203 of the corner stand 20 and the vertical mounting holes 303 of the corner support member 30 to affix the corner stand 200 and the corner support member 300 to the two beams 10.

A prototype of combination frame structure for table has been constructed with the features of FIGS. 1–7. The combination frame structure for table functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A combination frame structure comprising:

a beam, said beam comprising at least one longitudinal slot;

a plurality of stands for supporting said beam in horizontal, each said stand comprising a flat top for supporting said beam, and two legs connected to said flat top for supporting said flat top above the floor, said flat top having at least one mounting through hole corresponding to said at least one longitudinal slot of said beam;

a plurality of support members respectively fastened to said stands and supported on said beam for supporting a table board, each said support member comprising a flat base, and two support arms respectively extended from said flat base at two sides for supporting a table board above said beam, said flat base having at least one bottom mounting hole corresponding to said at least one longitudinal slot of said beam and said at least one mounting through hole of said stands.

2. The combination frame structure as claimed in claim 1, wherein the two legs of each said stand are downwardly obliquely extended from the respective flat top at two sides.

3. The combination frame structure as claimed in claim 2, wherein each said stand has a rack fixedly connected to one side thereof for holding things.

4. The combination frame structure as claimed in claim 1, wherein the two legs of each said stand includes a first leg vertically downwardly extended from a first side of the respective flat top, and a second leg downwardly outwardly extended from a second side of the respective flat top opposite to said fist leg.

5. The combination frame structure as claimed in claim 1, wherein the two support arms of each said support member are obliquely upwardly extended from two sides of the respective flat base.

6. The combination frame structure as claimed in claim 1, further comprising a spacer block set between each two adjacent support members for supporting a table board on said beam.

7. The combination frame structure as claimed in claim 6, wherein said spacer block comprises at least one bottom rod inserted through the at least one longitudinal slot of said beam and fixedly connected to a stop plate below said beam.

8. The combination frame structure as claimed in claim 1, further comprising a corner stand, said corner stand having a flat top and a leg extended from one side of the flat top for standing on the floor.

9. The combination frame structure as claimed in claim 8, wherein the leg of said corner stand extends downwardly outwards from one side of the flat top of said corner stand.

10. The combination frame structure as claimed in claim 1, further comprising a corner support member for supporting a corner table board on said beam, said corner support member comprising a flat base and a support arm extended from said flat base for supporting a corner table board.

11. The combination frame structure as claimed in claim 10, wherein the support arm of said corner support member extends upwardly outwards from one side of the flat base of said corner support member.

12. A combination table using the combination frame structure as claimed in claim 1.

13. A combination table using the combination frame structure as claimed in claim 9.

* * * * *